US005522738A

United States Patent [19]

Lace

[11] Patent Number: 5,522,738

[45] Date of Patent: Jun. 4, 1996

[54] ELECTRICAL CONNECTOR JACK

[75] Inventor: Melvin A. Lace, Prospect Heights, Ill.

[73] Assignee: Thomas E. Dorn, Clarendon Hills, Ill.; a part interest

[21] Appl. No.: 324,900

[22] Filed: Sep. 18, 1994

[51] Int. Cl.[6] ..... H01R 17/18

[52] U.S. Cl. ..... 439/669; 439/181

[58] Field of Search ..... 439/515, 669, 439/668, 181, 186, 187

[56] References Cited

U.S. PATENT DOCUMENTS

| | | | |
|---|---|---|---|
| 1,526,102 | 2/1925 | Taft | 439/669 |
| 2,470,915 | 5/1949 | Bosh | 439/669 |
| 4,359,135 | 11/1982 | Tsuge et al. | 439/188 |
| 5,213,517 | 5/1993 | Kerek et al. | 439/181 |

*Primary Examiner*—Gary F. Paumen

*Assistant Examiner*—T. C. Patel

*Attorney, Agent, or Firm*—Dorn, McEachran, Jambor & Keating

[57] ABSTRACT

An electrical connector jack for a conventional two-conductor electrical connector plug; the plug is inserted into the jack in a given direction to connect a signal source to an amplifier with minimal or no noise when the connection is made. The plug has concentric electrically isolated tip and ring electrodes, with the tip projecting beyond the ring in the direction of insertion. The jack includes two signal contacts (one may be grounded) engageable individually with the tip and ring electrodes of the plug when the plug is fully inserted into the jack; these signal contacts are electrically connected to a signal source such as a guitar pickup. A shorting contact engages and interconnects the tip and ring electrodes until the plug is fully inserted. The signal contacts and the shorting contact may have a common insulator support.

14 Claims, 2 Drawing Sheets

ELECTRICAL CONNECTOR JACK

BACKGROUND OF THE INVENTION

The conventional tip and ring connector plug utilized in many telephone applications is also used in a number of musical instruments such as guitars, bass guitars, banjos and the like. The plug-and-jack connector is often required to perform a variety of different functions. Thus, in completing a signal connection the conventional plug connector may be required to switch a power source to an amplifier; the power source may have an operating voltage of 9 volts. The connector may also be required to mute other signal connections.

When an ordinary telephone-type connector plug is first plugged into a conventional jack, it almost always touches the sleeve of the jack, which is usually grounded. This produces a rather loud clicking and humming sound which can be very disturbing to listeners. This noise results because the tip electrode of the plug, which is usually the "hot" side of the signal circuit, is connected temporarily to the wrong side of the source of signals to be supplied to the amplifier. In the case of an electrical guitar, the tip electrode may actually be connected temporarily to the body of the guitar and even to the guitar player. The noises produced when a plug-and-jack connection is made have long been a problem and a handicap to guitar players, particularly in instances when the connection is made in the course of a performance. Even in those instances in which the connection is completed before the performance begins, the resultant noise is quite objectionable.

STATEMENT OF THE INVENTION

It is a principal object of the present invention, therefore, to provide a new and improved jack for receiving a connection plug of the tip and ring type, a jack that does not cause the generation of noise at the time a plug-and-jack connection is completed.

Another object of the invention is to provide a new and improved jack for a conventional tip/ring plug connector that is essentially noise free, yet requires little or no increase in the cost of the connector jack.

Accordingly, the invention relates to an electrical connector jack that receives an electrical connector plug inserted into the jack in a given direction to connect an amplifier and speaker to a signal source. The plug includes first and second aligned electrically conductive plug electrodes that are electrically isolated from each other; the first plug electrode projects beyond the second plug electrode when the plug is aligned with the jack in the given direction. The jack of the invention may comprise an insulator support, and first and second electrically conductive signal contacts mounted on the support; these contacts engage the first and second plug electrodes, respectively, in electrically conductive contact when the plug is fully inserted into the jack. The jack further comprises means for electrically connecting the signal contacts to a signal source. An electrically conductive shorting contact is mounted on the support in position to engage and to interconnect the plug electrodes as the plug is initially inserted into the jack; the shorting contact maintains the plug electrodes electrically interconnected until the plug is fully inserted into the jack and the plug electrodes engage the signal contacts.

DESCRIPTION OF THE PREFERRED EMBODIMENT

Figure 1:
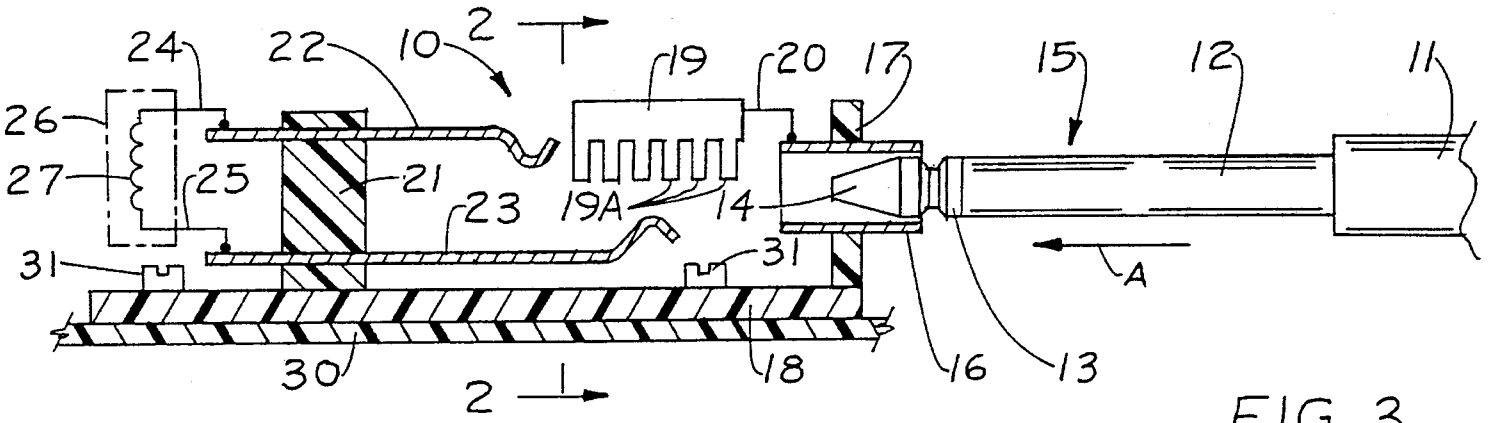
FIG. 1 is a schematic illustration of an electrical connector jack, for use with a conventional tip/ring plug, constructed in accordance with one embodiment of the present invention, showing the jack and plug when the plug is first inserted into the jack.

FIG. 1 illustrates an electrical connector jack 10 constructed in accordance with the present invention; jack 10 is employed in conjunction with a plug connector 15 to complete an electrical circuit through a two-conductor cable 11. Plug 15 is mounted on the end of cable 11 and is inserted into jack 10 by moving the plug in the direction indicated by the arrow A.

Plug 15, as shown, is of conventional construction. It includes a first plug member or electrode 12. Plug member 12, sometimes referred to as a ring electrode, terminates at an annular insulator 13 that electrically isolates ring electrode 12 from a second plug electrode, tip electrode 14. In many conventional plugs of the kind illustrated by plug 15, the maximum diameter of tip electrode 14 is the same as the maximum diameter of ring electrode 12. Tip electrode 14 is connected to a conductor (not shown) that extends through ring electrode 12, and each of the tip and ring electrodes of plug 15 is connected to a conductor (not shown) in cable 11. The tip electrode 14 projects beyond ring 12 when plug 15 is aligned with jack 10 in the direction indicated by arrow A. Tip electrode 14 is on the "hot" side of the circuit, in most instances; ring electrode 12 may be grounded when the connection through plug 15 and jack 10 is complete.

Figure 2:
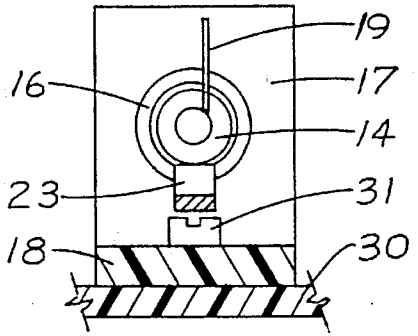
FIG. 2 is a schematic sectional view, on a somewhat enlarged scale, taken approximately as indicated by line 2—2 in FIG. 1.

Jack 10 includes a support structure, of insulating material comprising a base 18, a front support 17, and a rear support 21. In the construction illustrated in FIG. 1, a conductive guide sleeve 16 having an inner diameter corresponding to the outer diameter of ring electrode 12 is mounted in the front support 17. Sleeve 16 is electrically connected by a conductor 20 to a thin, resilient metal shorting contact member 19 having a plurality of contact fingers 19A. Member 19 may be formed of a thin sheet of tempered spring bronze. The orientation of members 16–19 relative to each other, and relative to the tip electrode 14, is shown in FIG. 2.

Jack 10 further comprises first and second electrically conductive signal contacts 22 and 23 that are mounted on the insulator support member 21 as shown in FIG. 1. Any desired mounting means may be employed. The one signal contact 23 also appears in FIG. 2. Signal contact 22 is connected to one end of a coil 27 that is a part of a signal source 26; the connection comprises a conductor 24. Another conductor 25 connects the other terminal of source 26 to contact 23 of jack 10. In a guitar, this connection is usually grounded. The base 18 of jack 10 may be mounted upon a guitar housing or other stable surface 30 by appropriate means such as a pair of mounting devices 31; see FIGS. 1 and 2.

Figure 3:
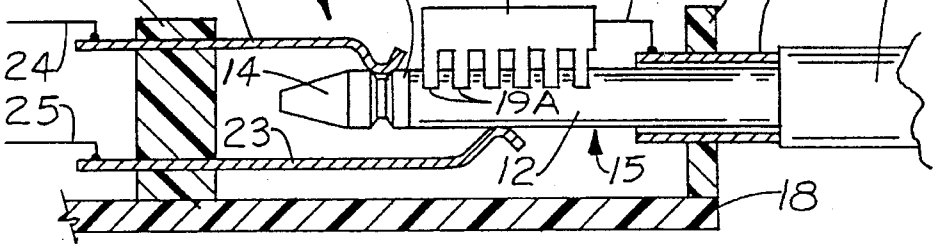
FIG. 3 is an illustration like FIG. 1 but showing the position of the components of the plug and jack when the plug has been fully inserted into the jack.
Figure 4:
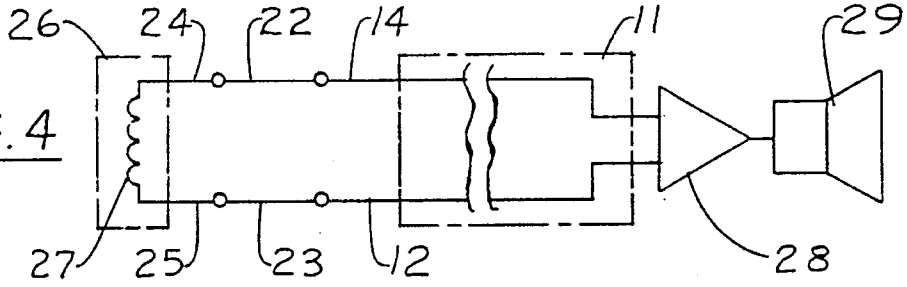
FIG. 4 is a schematic diagram of a typical circuit in which the plug and jack of FIGS. 1–3 is utilized.

FIG. 3 shows the plug 15 and jack 10 with the plug fully inserted into the jack, completing the electrical circuit shown schematically in FIG. 4. When the plug-and-jack connection is completed, the end of cable 11 abuts sleeve 16 so that the person using the plug and jack connection (often a guitar player) knows that the connection is complete. Ring electrode 12 of plug 15 is in electrical contact with sleeve 16 of jack 10. The ring electrode is also in electrical contact with the fingers 19A of contact member 19. This connection of electrode 12 to the shorting contact comprising members 16, 19 and 20, however, is immaterial to overall circuit operation. Ring member 12 is engaged with and is electrically connected to signal contact 23 which, of course, is connected to conductor 25 and hence to one end of coil 27 in the signal source, guitar pickup 26. See FIG. 4. Tip electrode 14 of plug 15 is engaged by and is in electrical contact with the other signal contact 22 of jack 10, as shown in FIG. 3. Consequently, tip 14 is electrically connected to conductor 24 and, as indicated in FIG. 4, is connected to the other end of coil 27 in signal source 26. The complete circuit, shown in FIG. 4, provides connection through cable 11 to an amplifier 28 which drives a speaker 29.

The critical stage of operation for connector jack 10, which constitutes the present invention, starts with FIG. 1 and is maintained with continuing movement of plug 15 into jack 10, in the direction of arrow A, until the final connected condition is reached, FIG. 3. Intermediate stages are shown in FIGS. 5, 6 and 7.

When plug 15 first moves into jack 10, as shown in FIG. 1, the tip electrode 14 almost inevitably touches and establishes electrical contact with sleeve 16. But sleeve 16 is not grounded and the connection 20 to contact member 19 is of no consequence electrically. Accordingly, when tip 14 engages sleeve 16 there is no signal supplied to amplifier 28 through cable 11 (see FIG. 4) and there is no noise output from speaker 29.

Figure 5:
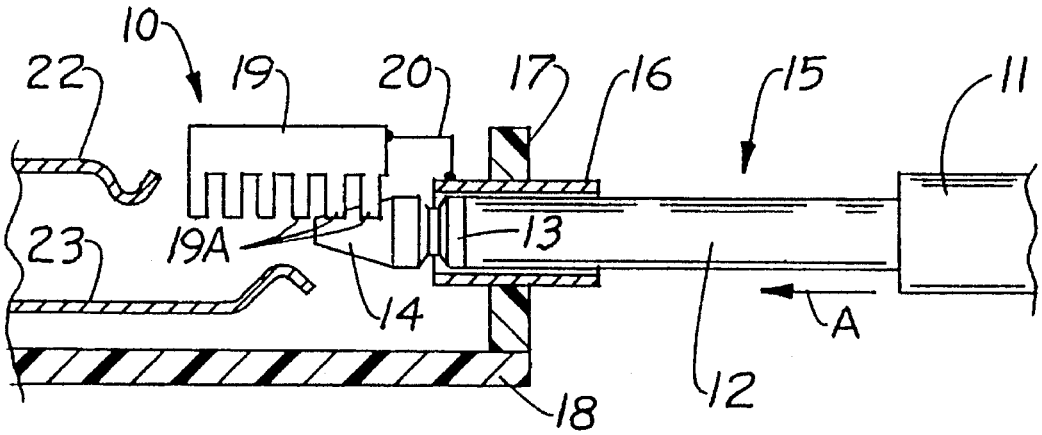
FIGS. 5, 6 and 7 are sequential views illustrating the movement of the plug into the jack at intermediate stages between FIG. 1 and FIG. 3.

Continued movement of plug 15 into jack 10 brings the plug to the position shown in FIG. 5, in which the first few fingers 19A of shorting member 19 touch and establish electrical contact with the tip electrode 14 of the plug. At the same time, the ring electrode 12 of plug 15 engages and is in electrical contact with sleeve 16. Consequently, because sleeve 16 is connected to shorting contact 19 by conductor 20, the ring and tip electrodes 12 and 14 of plug 15 are electrically interconnected; they are shorted to each other. The electrical consequence is that the input to amplifier 28 is shorted. There is no noise to be amplified and reproduced by speaker 29, FIG. 4.

Figure 6:
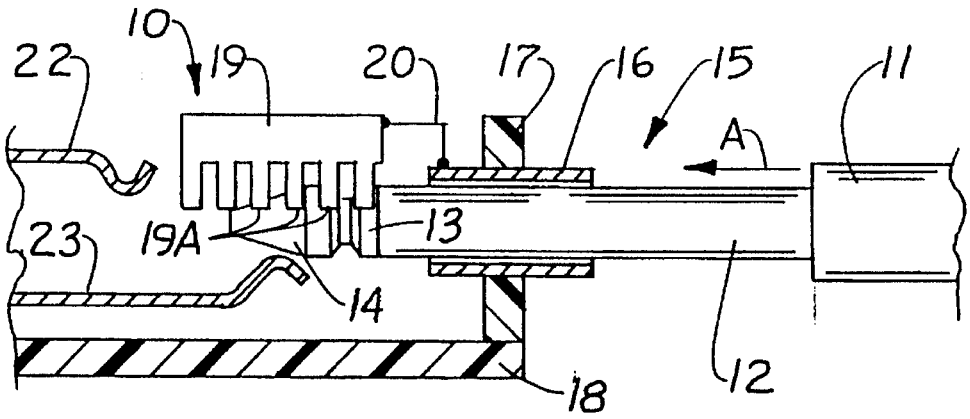
Figure 7:
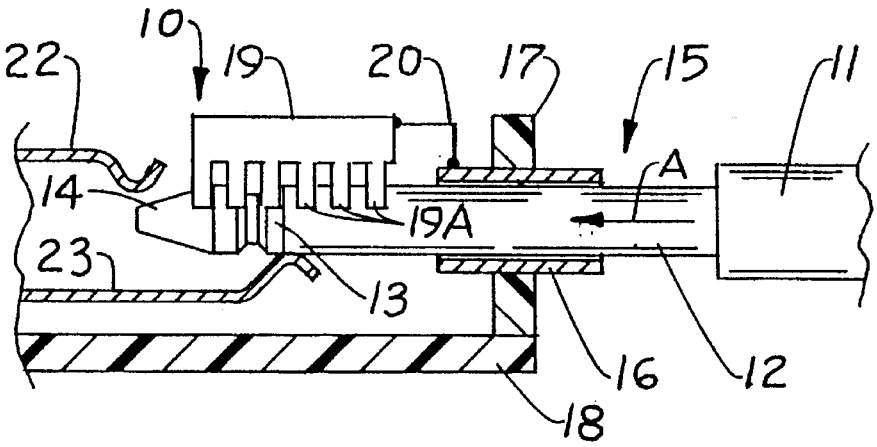

The next subsequent stage for the interconnection of plug 15 and jack 10 is shown in FIG. 6, with the plug further advanced into the jack in the direction of arrow A. Physically, conditions have changed, but the electrical condition is the same as in FIG. 5. The only real difference is that the fingers 19A of shorting contact member 19 now electrically engage both the tip 14 and the ring 12 of plug 15 and interconnect the plug electrodes. Sleeve 16 might as well not be there. Thus, at this stage the tip and ring electrodes of plug 15 are still shorted to each other and there is no noise output from amplifier 28 and speaker 29, FIG. 4.

FIG. 7 illustrates the relationship that obtains when plug 15 is nearing final insertion into jack 10. At this juncture, tip electrode 14 of plug 15 has not yet come into contact with the "hot" signal contact 22 of jack 10. The other signal contact 23 of jack 10 has just reached engagement with and electrical contact with ring 12 of the plug. But tip electrode 14 and ring electrode 12 are still shorted to each other through contact member 19 and its fingers 19A. There still is no noise.

From the condition shown in FIG. 7, plug 15 continues its movement into jack 10, reaching the operating condition illustrated in FIG. 3. That is, the shorting contact of jack 10, of which the principal element is shorting member 19, maintains an electrical short or interconnection between the two plug electrodes, ring electrode 12 and tip electrode 14, until plug 15 is fully inserted into jack 10 and the tip and ring electrodes of the plug engage the signal contacts 22 and 23, respectively, of the jack. During the entire operation, due to the presence of the shorting contact comprising elements 16, 19 and 20, there has been no abrupt electrical signal supplied to amplifier 28 (FIG. 4) and no noise output from the speaker 29 driven by that amplifier. Contact 22 engages tip electrode 14 to hold the plug-and-jack connection together.

When a switching operation is carried out by plug 15 and jack 10, as described above and as illustrated in FIGS. 1–3 and 5–7, the tip electrode 14 of plug 15 is exposed to the power voltage, usually 9 volts, employed to actuate amplifier 28. This can be quite damaging to the main power amplifier, and can even destroy the operating cone of speaker 29. This abrupt transition in power levels is effectively avoided by jack 10 with only a minor increase in cost of the jack; in some instances there is no increase at all.

Plugs and jacks of many sizes, shapes, and descriptions are in common use on musical instruments, amplifiers, and speakers, and, indeed, in a wide variety of other communication applications. It will be recognized that the constructions illustrated in FIGS. 1–3 and 5–7 are essentially schematic in nature; they clearly do not represent even a fraction of the various mechanical arrangements that can be utilized to carry out the invention. The overriding feature of the invention is that it consistently provides electrically conductive shorting contact between the tip and ring electrodes of the plug in a plug-and-jack connector throughout the time that the plug is being inserted into the jack and until the final connection to the signal contacts of the jack is completed. The physical arrangement used for the essential shorting connection is subject to substantial variation. Metal sleeve 16 and flexible conductive contact member 19 constitute one arrangement that may be used, mechanically, to carry out the invention. But it will be apparent that a flexible metal sleeve or contact or even a flexible conductive rubber strip can be used to the same end. The shapes and orientation of the elements of jack 10 can be varied to meet requirements imposed by virtually any tip-and-ring plug. The key to the invention is maintenance of the electrical short circuit between the tip and ring electrodes of the plug until the final completion of the operating circuits between the plug electrodes and the jack contacts.

I claim:

1. An electrical connector jack that receives an electrical connector plug inserted into the jack in a given direction to connect an amplifier and speaker to a signal source, the plug including aligned electrically conductive tip and ring plug electrodes electrically isolated from each other, the tip plug electrode projecting beyond the ring plug electrode when the plug is aligned with the jack in the given direction, the jack comprising:

an insulator support;

first and second electrically conductive signal contacts, mounted on the support, for engaging the tip and ring plug electrodes, respectively, in electrically conductive contact when the plug is fully inserted into the jack;

connector means for electrically connecting the signal contacts to an external signal source; and an electrically conductive shorting contact mounted on the support in position to engage and interconnect both plug electrodes as the plug is initially inserted into the jack;

the shorting contact maintaining the plug electrodes electrically interconnected until the plug is fully inserted into the jack and the plug electrodes engage the signal contacts.

2. An electrical connector jack for use with a connector plug, according to claim 1, in which one of the signal contacts is a resilient metal member, mounted on the support.

3. An electrical connector jack for use with a connector plug, according to claim 1, in which each signal contact is a resilient metal contact member.

4. An electrical connector jack for use with a connector plug, according to claim 1, in which the shorting contact of the jack includes a plural finger resilient metal shorting contact member which engages both the tip and ring plug electrodes during insertion of the plug into the jack.

5. An electrical connector jack for use with a connector plug, according to claim 4, in which the shorting contact further includes a conductive sleeve engaging and guiding the plug into the jack, in the given direction, and an electrical connection between the conductive sleeve and the shorting contact member.

6. An electrical connector jack for use with a connector plug, according to claim 1, in which the support of the jack is mounted on a musical instrument and the signal source is a musical instrument pickup.

7. An electrical connector jack for use with a connector plug, according to claim 6, in which the musical instrument is a guitar.

8. An electrical connector jack that receives an electrical connector plug inserted into the jack in a given direction to connect an amplifier and speaker to a signal source, the plug including aligned electrically conductive tip and ring electrodes electrically isolated from each other, the tip plug electrode projecting beyond the ring electrode when the plug is aligned with the jack for insertion, the jack comprising:

first and second electrically conductive signal contacts, for engaging the tip and ring electrodes of the plug, respectively, in electrically conductive contact when the plug is fully inserted into the jack;

connector means for electrically connecting the signal contacts to an external signal source; and an electrically conductive shorting contact positioned to engage and interconnect the tip and ring electrodes of the plug as the plug is initially inserted into the jack;

the shorting contact maintaining the tip and ring electrodes of the plug electrically interconnected until the plug is fully inserted into the jack and the plug electrodes engage the signal contacts.

9. An electrical connector jack for use with a connector plug, according to claim 8, in which one of the signal contacts is a flexible resilient, electrically conductive member.

10. An electrical connector jack for use with a connector plug, according to claim 8, in which each signal contact is a flexible, resilient electrically conductive metal contact member.

11. An electrical connector jack for use with a connector plug, according to claim 8, in which the shorting contact of the jack includes a plural finger resilient metal shorting contact member which engages both the tip and ring electrodes of the plug during insertion of the plug into the jack.

12. An electrical connector jack for use with a connector plug, according to claim 11, in which the shorting contact further includes a conductive sleeve engaging and guiding the plug into the jack, in the given direction, and an electrical connection between the conductive sleeve and the shorting contact member.

13. An electrical connector jack for use with a connector plug, according to claim 8, in which the jack is mounted on a musical instrument and the signal source is a musical instrument pickup.

14. An electrical connector jack for use with a connector plug, according to claim 13, in which the musical instrument is a guitar.

* * * * *